United States Patent [19]

Preiss

[11] 4,388,043

[45] Jun. 14, 1983

[54] CONDUCTIVITY DEPENDENT PUMP AND PROCESS CONTROL

[75] Inventor: Gunther W. B. Preiss, Fremont, Calif.

[73] Assignee: Trevex Corporation, Hayward, Calif.

[21] Appl. No.: 332,862

[22] Filed: Dec. 21, 1981

[51] Int. Cl.[3] ..... F04B 49/06

[52] U.S. Cl. ..... 417/36; 324/448; 324/449

[58] Field of Search ..... 417/36, 148, 149, 234; 324/447, 448, 449

[56] References Cited

U.S. PATENT DOCUMENTS

| | | | |
|---|---|---|---|
| 2,910,940 | 11/1959 | Colman et al. | 417/63 X |
| 3,373,351 | 3/1968 | Rak | 324/449 |
| 4,072,892 | 2/1978 | Lind | 324/448 |

FOREIGN PATENT DOCUMENTS

| | | | |
|---|---|---|---|
| 1256197 | 2/1961 | France . | |
| 1286628 | 8/1972 | United Kingdom | 417/36 |
| 2052061 | 1/1981 | United Kingdom | 417/36 |
| 478955 | 10/1975 | U.S.S.R. | 417/36 |

*Primary Examiner*—Edward K. Look

*Attorney, Agent, or Firm*—James A. Giblin

[57] ABSTRACT

Device for activating or inactivating a liquid pump on the basis of the electrical conductivity of a liquid. Device comprises, in combination, a housing having a passageway through which a liquid can flow, a pair of conductivity-sensing electrodes disposed near or in the passageway, means for connecting the passageway to a liquid pump, and means for connecting the electrodes to a conductivity-dependent pump activator connected to the pump. Device provides through-the-probe pumping and is adaptable for manual operation or in-line liquid control.

7 Claims, 6 Drawing Figures

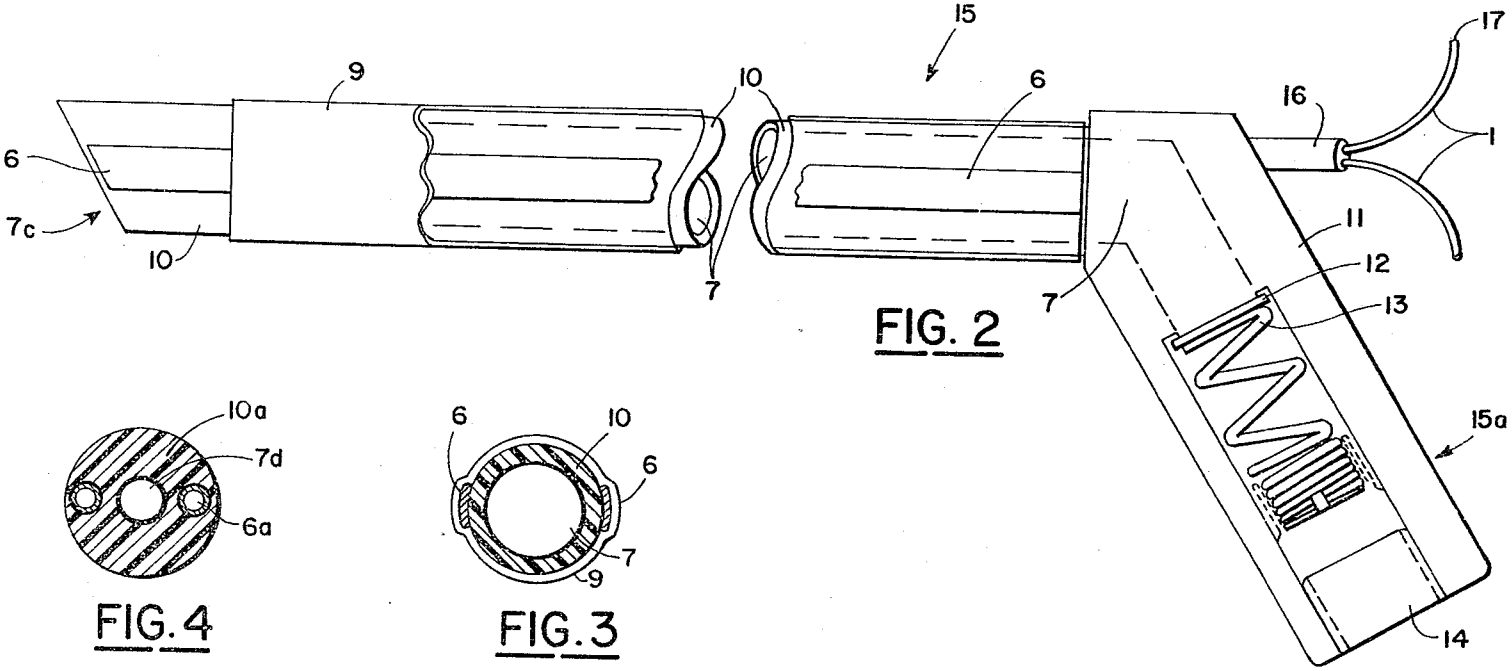
FIG. 2
FIG. 3
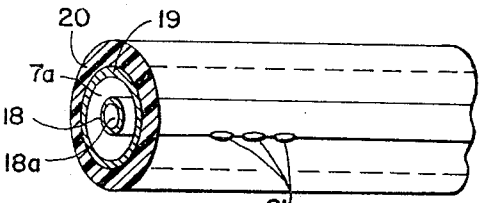
FIG. 6
FIG. 4
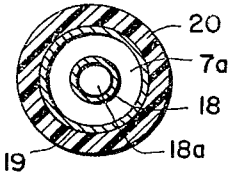
FIG. 5

CONDUCTIVITY DEPENDENT PUMP AND PROCESS CONTROL

BACKGROUND OF THE INVENTION

1. Field

This disclosure is concerned generally with a pump-controlling device and specifically with a probe or monitoring device adapted to activate or inactivate a liquid pump on the basis of the electrical conductivity of a given liquid.

2. Prior Art

In recent years, increasing attention has been given to devising safe methods for the storage, transfer and disposal of dangerous, potentially dangerous and/or corrosive liquids. This has been especially true within organizations or industries which, on a regular basis, use relatively large vats, tanks or drums of highly acidic or alkaline solutions for cleaning, neutralizing, etching or otherwise treating materials. For example, the ever-expanding semi-conductor industry commonly uses relatively large volumes of acids (i.e. hydrofluoric, hydrochloric, and the like) for etching purposes. Such acids are often held in open tanks into which various components can be submerged for treatment. In time, these solutions become spent and they must be transferred to other containers for disposal or, perhaps, purification or renewal.

In other cases, such solutions may be part of a continuous flow processing system and, at some point, it may become necessary to monitor the liquid flow through such systems to assure that a liquid having certain properties can either enter or not enter other systems. In any event, it can be appreciated that, for purposes of safety, pollution control or even simple economics, extreme care should be taken in the transfer of many liquids.

Some of the dangers inherent in the transfer of liquids become especially apparent in cases where an operator must physically insert a pump nozzle into a given liquid for transfer to another container which may already hold another liquid. In such cases, care must be taken to assure that a given liquid is in fact the one to be transferred and, if transferred, there will be no potentially dangerous consequences. A typical example would be the inadvertant transfer of water (or an aqueous solution) into a container of concentrated sulfuric acid.

Unfortunately, the identity of a given liquid is not always apparent to the operator of a pump used to transfer the liquid. Because of this, there have been unfortunate instances of personal injuries and property damage occurring as a direct result of placing a pump nozzle into an unknown (or even known) liquid.

In similar fashion, such injuries or damage can occur due to a failure to monitor the nature of liquids continuously flowing through a fluid flow system (e.g. accidental dumping of acids into sewer lines). Because of the likelihood of such injuries or damage, it would be highly desirable to have available a device which could be pre-set to activate or deactivate a liquid pump on the basis of some property of the liquid related to its potential for danger or damage. Ideally, such a device should be sensitive to a relatively unique and distinguishing feature of the liquid. Quite surprisingly, I have found that such device is possible. My discovery is especially surprising in that it is based on relatively simple principles, the combination of which, to my knowledge, has not been previously recognized. Details of my device are described below.

BRIEF DESCRIPTION OF THE FIGURES

FIG. 2 illustrates in partial cross section one of the preferred handholdable devices.

FIGS. 3, 4 and 5 illustrate cross-sectional views of various embodiments showing how the configuration of the electrodes and suction tubes may be varied depending on intended applications and/or conductivities.

FIG. 6 illustrates in partial cross section a coaxial probe/monitor, the cross section of which is shown in FIG. 5.

SUMMARY OF THE INVENTION

Figure 1:
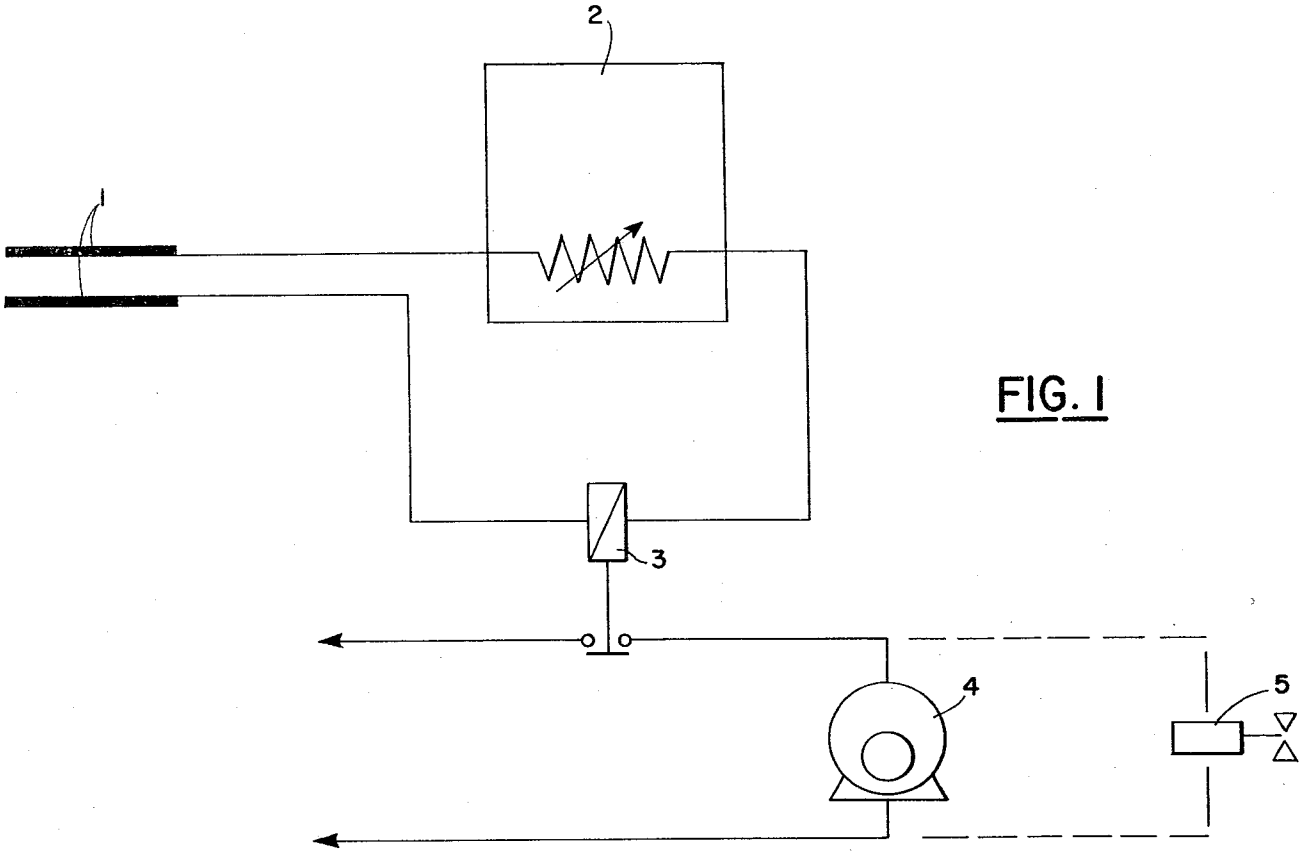
FIG. 1 is a simple schematic drawing illustrating one of the principle features of the invention.

The device of this invention is a control for activating or inactivating a liquid pump based on the electrical conductivity of a given liquid. The device may be used as a hand-held probe or as part of an in-line liquid flow monitoring system which is adapted to turn a pump on or off on the basis of a pre-determined conductivity or range of conductivity of a liquid. The device comprises, in combination, a housing having an internal passageway for liquid flow, a pair of conductivity-sensing electrodes disposes close to or in the passageway, means for connecting the passageway to a liquid pump and means for connecting the electrodes to a conductivity-dependent pump activation means which, itself, is in communication with the pump. In preferred embodiments the portion of the housing (and passageway) which comes into initial contact with a given liquid is very close to (or a part of) those portions of the electrodes which sense the conductivity of the same liquid. This proximity of the electrodes to that portion of the passageway which comes in initial contact with a given liquid permits substantially simultaneous contact of the liquid at the conductivity sensors (electrodes) and that part of the passageway at which a pumping (suction) action is initiated and/or maintained, thereby resulting in safe, prompt and accurate pump control. The liquid contacting surface areas of the electrodes, which work in combination with the conductivity-dependent pump activation means, should be large enough and close enough to respond to a pre-determined electrical conductivity in the liquid. The electrodes may have a variety of configurations and, especially in corrosive liquid applications, may be removable for cleaning and/or replacement. The device of this invention can be adapted for manual operation or be part of an in-line monitoring system.

SPECIFIC EMBODIMENTS

A very important aspect of this disclosure is that it contemplates a through-the-sensing probe pumping system in which the sensing electrodes are in close proximity to or a part of the passageway where pumping is initiated and/or maintained (e.g. at the suction tube orifice through which the liquid initial flows if pre-determined conditions of conductivity are present in the liquid). This close proximity enhances the overall safety, promptness, and useability of the pump control device.

Another important aspect of this invention is that it is based on an electrical conductivity sensitive pump activator (or inactivator). The terms conductivity, conductance, and the like, as used herein with respect to the device of this disclosure, refer to the property of a given liquid to conduct or transmit an electrical current. In the specific case of liquids, this property commonly is associated with the ease with which positive and negative ions can move through the liquid from one electrode to another electrode otherwise in circuit with the first electrode. Typically, a conductive liquid is electrolytic, at least to some degree. Although the degree of conductivity of a given liquid may be expressed as the reciprocal of that liquid's electrical resistivity (as measured in ohms), a more convenient unit for expressing degrees of conductivity is the mho (backward spelling of ohm) also known as the Siemens. Frequently, it is even more convenient to refer to units of conductance in terms of micromhos or microSiemens.

The conductivity-activated pumps of this disclosure can be set to operate at virtually any given unit or range of conductivity. This is an essential aspect of this invention in that it eliminates, or at the very least greatly minimizes, the possibility of an improper or dangerous liquid being inadvertantly pumped where not wanted. For example, the pump activation system in contact with the sensing electrodes can be set so that the pump will not be activated until the electrodes contact a very conductance liquid (e.g. a concentrated acid). This would then, for example, preclude an accidental and dangerous pumping of water or a dilute aqueous solution (low conductance) into a container which might hold concentrated sulfuric acid (high conductance). On the other hand, in cases where it might be desirable to avoid the inadvertant pumping of a high conductance liquid, the device could be set to activate the pump only if the electrodes contact a low conductance liquid. In yet another embodiment, in the case of liquids having a borderline conductance, a conductance discriminator may be introduced into the system to allow pump activation only if the conductivity of a given liquid falls within a certain range (or window) of conductivities.

The choice of electrode and housing material for the device may be dependent on intended applications. In cases where very high conductances are expected (e.g. concentrated acids, etc.), corrosion resistant electrode materials and/or electrodes having relatively small surface areas for liquid contact should be used. By using a corrosion-resistant material (e.g. stainless steel, platinum, etc.) and/or minimizing the electrode surface areas which contacts such liquids, electrode life is enhance. In cases where the anticipated conductances are lower (e.g. approaching that of deionized water or that of an essentially non-conductive hydrocarbon solvent), the surface areas of the electrodes should be correspondingly larger. As described below, to maximize such surface areas, the electrodes themselves may form all or portions of a suction tube through which a low conductance liquid is initially drawn. (e.g. coaxial electrodes in which the fluid flow passageway is also the chamber in which conductivity is sensed).

The electrodes are adapted (e.g. via simple lead wires) to be electrically connected to a pump activation means which, in turn, operates the pump (itself in communcation with the fluid flow passageway of the device). The pump activation means can be pre-set to operate the pump on the basis of the conductivity of the liquid between the electrodes as follows: For liquids expected to have a relatively high conductivity, a relatively low voltage (e.g., less than 20 V) power supply and relay system of the same value are chosen. For example, in cases where the anticipated liquid conductivity is high (e.g. concentrated acid solutions) and the distance between the exposed portions of the electrodes is small (2 cm or less), a 5 volt power supply and relay would be appropriate. In the case of low conductivity liquids, a simple amplifier may be used. To discriminate between high and low conductivities, a comparator having a given reference voltage may be used to activate or inactivate the pump depending on whether the conductivity is sufficient to be "sensed" at a given reference voltage. It can be appreciated that a given threshold voltage setting allows for tuning to a specific conductance of a liquid. Using one application of their disclosure, it has been possible to "sense" a liquid having an electrical conductivity of less than about 0.1 micromhos.

Reference should now be made to the Figures wherein detailed descriptions can be seen.

FIG. 1 illustrates schematically the conductivity activated pump device. The figure shows a pair of electrodes 1 in electrical contact with a variable power supply 2 and relay 3. When both electrodes 1 contact a liquid having a conductance sufficient to allow variable power supply 2 to activate relay 3, an electrical circuit for solenoid valve 5 and pump 4 can be completed, thereby making activation of liquid pump 4 directly dependent on the conductance "sensed" in the liquid between electrodes 1 which conductance level also completes the circuit between the electrodes.

FIGS. 2–6 show variations of several preferred embodiments of this disclosure. FIG. 2 shows a device which can be used as a manual probe/pump to tranfer liquids of a pre-determined or known conductivity. The device consists of a housing 15 having an interior elongated passageway 7 (seen at the broken portion of FIG. 2 and seen headon at the sensing tip shown in FIG. 3) which is essentially a suction tube which begins at the left end of the housing 7*c* and ends at pump connector 14 located at the bottom of handle 15*a*. Pump connector 14 may be of any conventional coupling design such as a simple screw or snap on hose fitting. Along side housing 15 are a pair of conductivity sensing electrodes 6 which can be partially covered by an outer mantel 9 (e.g. may be a shrink wrap). In the embodiment of FIG. 2 the electrodes are made of a durable conductive material such as stainless steel or any other material compatable with the liquid used and are removable and replacable as needed by simply undoing outer mantel 9, removing electrodes 6 (which may be attached by conventional means such as screws or the shrink wrap itself) and replacing mantel 9. The housing of FIG. 2 may be made of a variety of essentially non-conductive materials such as polymeric materials known to those skilled in the art. FIG. 2 also shows an electrical cord 16 and leads 17 which are connectable to a specific conductivity activated power supply which activates the pump and, if desired, other systems such as buzzers, lights, meters and the like. By having easily replaceable sensor electrodes 6, the device of FIG. 2 is especially useful as a probe/pump for especially corrosive liquids (which typically may have a relatively high conductivity of one mho or more). Handle 15*a* may also include an adjustable check valve 12 held closed by spring 13. The replaceable electrodes may be attached to the housing 15 via insertion in dovetail grooves (mortices) on opposite sides of the housing. This permits easy replacement of electrodes by insertion of a new pair of electrodes into the dovetail grooves from the handle end of the suction tube. Forward movement can be halted by simple right angle bends through which the electrodes may be screwed to the housing 15. This mode of attachment avoids the use of shrink wrap and the potential traping (via capillary action) of liquid under the wrap which, in some cases, can cause a short circuit in the device.

The front sensing portion of the device of FIG. 2 can be seen more clearly in FIG. 3 which shows interior passageway 7 (the suction tube) defined by housing 10 on opposite sides of which are attached electrodes 6 held in place by mantel 9.

FIG. 4 shows yet another embodiment (seen head on from the sensing portion, equivalent to *7c* in FIG. 2,) in which electrodes 6*a* are embedded in housing 10*a* in close proximity to suction tube passageway 7.

Yet another embodiment, FIGS. 5 and 6 show a probe/pump activator which allows pumping liquid through a coaxial sensor. This design is especially useful in pumping liquids having a relatively low conductivity. In FIGS. 5 and 6, the electrodes consist of an outer electrode tube 19 held in tubular housing 20 and defining a central measuring chamber 7*a* which is a centrally located second electrode 18, itself and tubular member defining a second chamber 18*a*. In the embodiments illustrated in FIGS. 5 and 6, a liquid conductivity can be sensed in and the liquid can flow through measuring chamber 7*a*. In addition, the liquid can also flow through chamber 18*a* within tubular electrode 18. To avoid possible nonmovement of liquid in flow chamber 18*a*, inner electrode tube 18 may include openings 21 to allow satisfactory flow through chamber 18 into conductivity sensing chamber 7*a*. These openings may be seen in FIG. 6. It should be noted that the embodiment illustrated by FIGS. 5 and 6 allow not only "through-the-probe pumping", but also permit the device of this disclosure to be used for in-line process control. An example of this type of application would be for a system adapted to preclude passage of undesirable liquids (having a given conductivity range or conductivity minimum or maximum). In such cases, the electrical sensing circuit can include a simple on-off controller using a low voltage relay coil or it can include an electrical discriminator in which a narrow window can be moved across a wide range of conductancies in liquids, thereby allowing highly selective process control.

It can be appreciated that the above described Figures and examples are merely illustrative of the invention and that, given this disclosure, other variations will occur to those skilled in the art. Accordingly, it is intended that the invention being disclosed herein should be limited only by the following claims.

I claim:

1. A device for activating or inactivating a liquid pump on the basis of the electrical conductivity of a liquid, the device comprising, in combination, a housing having a passageway through which a liquid can flow, a pair of electrodes disposed about the passageway, means for connecting the passageway to a liquid pump and means for connecting the electrodes to a conductivity-dependent pump activation means in communication with the pump, the pair of electrodes comprising a generally tubular outer electrode coaxially disposed about a generally tubular inner electrode, the electrodes being separated by a liquid conductivity measuring chamber, and the inner electrode including an opening for initial liquid contact and an opening adapted to permit liquid communication through the tubular inner electrode and the conductivity measuring chamber.

2. The device of claim 1 wherein the pair of electrodes and the passageway are adapted to permit substantially simultaneous initial contact with a liquid having a given conductivity.

3. The device of claim 1 wherein the liquid contacting surfaces area of the electrodes, in combination with the conductivity-dependent pump activation means, is sufficient to be electrically sensitive to liquids having an electrical conductivity of less than about 0.1 micromhos.

4. The device of claim 1 wherein the outer electrode is embedded in the housing and exposable to a liquid at a liquid probing portion of the device.

5. The device of claim 1 wherein the electrodes are removable from the housing.

6. The device of claim 1 wherein the (device is adapted to be manually operated) housing of the device has two end portions, a conductivity sensing end, and a handle end, the handle end comprising a portion of the external surface of the housing.

7. The device of claim 1 wherein the (device is adapted to form part of a continuous liquid flow monitoring system) housing includes a generally tubular passageway in which the electrical conductivity of a continuous liquid flow can be monitored.

* * * * *